United States Patent [19]

Malott

[11] 4,045,928

[45] Sept. 6, 1977

[54] END CAP AND CONNECTORS FOR ROOF RIDGE VENTILATOR

[75] Inventor: Richard C. Malott, Spring Lake, Mich.

[73] Assignee: Leigh Products, Inc., Coopersville, Mich.

[21] Appl. No.: 597,036

[22] Filed: July 18, 1975

[51] Int. Cl.[2] ..... B65D 43/06; F24F 7/02; F16L 55/10

[52] U.S. Cl. ..... 52/199; 98/42 A; 138/89; 220/DIG. 19; 52/465; 220/355

[58] Field of Search ..... 52/198; 98/42, 42.1, 98/42 A; 220/352, 356, 306, DIG. 19, 355; 138/89; 215/317, 319

[56] References Cited

U.S. PATENT DOCUMENTS

| | | | |
|---|---|---|---|
| 781,538 | 1/1905 | Lyster | 98/32 |
| 2,228,435 | 1/1941 | Binon | 220/DIG. 19 |
| 2,266,270 | 12/1941 | Roth | 215/317 |
| 3,066,594 | 12/1962 | Lindner | 98/42.1 |
| 3,073,235 | 1/1963 | Smith et al. | 98/42.1 |
| 3,295,711 | 1/1967 | Abrams | 220/306 |
| 3,303,773 | 2/1967 | Smith et al. | 98/42.1 |
| 3,317,069 | 5/1967 | Chin | 215/319 |

*Primary Examiner*—William Price
*Assistant Examiner*—Allan N. Shoap
*Attorney, Agent, or Firm*—Price, Heneveld, Huizenga & Cooper

[57] ABSTRACT

Connectors and end caps are provided to connect adjacent roof ridge ventilator sections and to close the ends of the assembly. The connectors include a cutout, intermediate wall, an outer jacket and inner sleeve defining slots to receive the ends of adjacent ventilator sections. The end caps include a deflectable wall having a central depression and bulge. An outer end cap jacket and inner end cap sleeve define a channel to receive the end of the ventilator assembly.

5 Claims, 11 Drawing Figures

END CAP AND CONNECTORS FOR ROOF RIDGE VENTILATOR

BACKGROUND OF THE INVENTION

This invention relates to roof ridge ventilator assemblies and, more particularly, it concerns improved end caps and connectors for such assemblies.

Natural attic ventilation systems generally include an eaves ventilator and a roof ridge ventilator, both of which extend longitudinally the length of the building. Such systems function to remove warm air from an attic space during the summer months to cool the attic eliminating the necessity for or reducing air conditioning loads. During the winter months, such ventilation systems serve to remove moisture from the attic space to prevent soaking and deterioration of the ceiling insulation material. The roof ridge ventilator assemblies must be compact and aesthetically pleasing and still be capable of withstanding exposure to high winds, rain, snow, sunlight and various forms of air pollution. Preferably, they should have a low silhouette.

Ridge ventilation assemblies generally take the form of somewhat T-shaped hooded sections joined together and extending longitudinally along the ridge of a roof. The ends of the ventilator assembly are closed by cap-like elements.

SUMMARY OF THE INVENTION

In accordance with the present invention, improved roof ridge ventilator end cap and connector or joiner elements are provided resulting in communication between adjacent ventilator sections, waterproof joints without the necessity of an external cover elements, and the ability to permit ready adaptation of a roof ridge ventilator assembly to roofs of different pitches. Essentially, a joiner or connector is provided having a cutout, intermediate wall shaped so as to conform with the cross section of a roof ridge ventilator section, a peripherally extending outer jacket and an inner sleeve spaced from the outer jacket and defining therebetween a slot extending around a major portion of the cutout wall and adapted to receive the ends of adjacent roof ridge vent sections. An upstanding inner jacket and an angled depending flashing portion are adapted to receive the inner sidewalls and flashing portions of adjacent roof ridge vent sections.

An end cap is provided having a deflectable wall shaped to enable it to conform with the cross section of a ridge ventilator section and including a main body portion and a depending leg portion. An outer peripheral jacket and a spaced inner sleeve extend around the periphery of the deflectable wall so as to define a channel within which the end of a ventilator section is disposed. The deflectable wall is formed with a central depression extending downwardly and terminating in an outwardly directed bulge.

DETAILED DESCRIPTION OF THE PREFERRED EMBODIMENT

Figure 1:
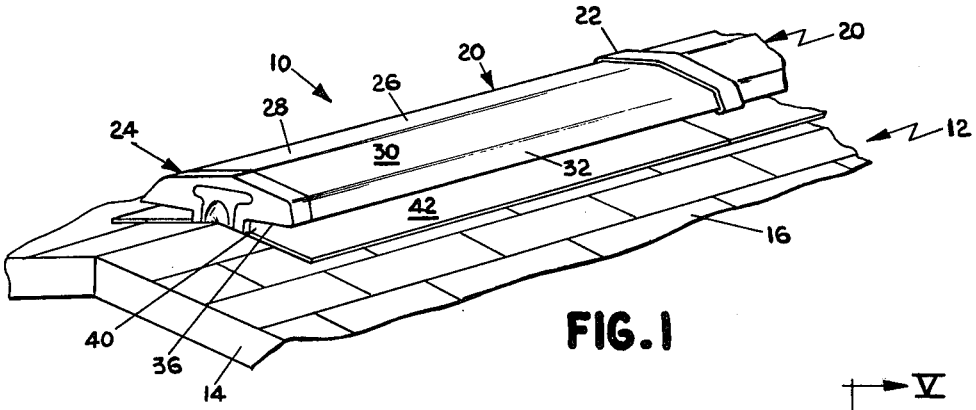
FIG. 1 is a fragmentary perspective view illustrating a roof ridge ventilator assembly including the improved end cap and connector elements of the subject invention.

With reference to the drawings, FIG. 1 illustrates a roof ridge vent assembly generally designated 10 mounted on the top of the ridge of a roof 12. The roof structure is conventional and includes rafters 14 and sheathing boards (not shown) covered by shingles 16. The ridge vent assembly includes a plurality of longitudinally extending vent sections 20. Each section 20 is connected by a connector or joiner 22 and the ends of the ridge vent assembly are closed by end caps 24.

Figure 3:
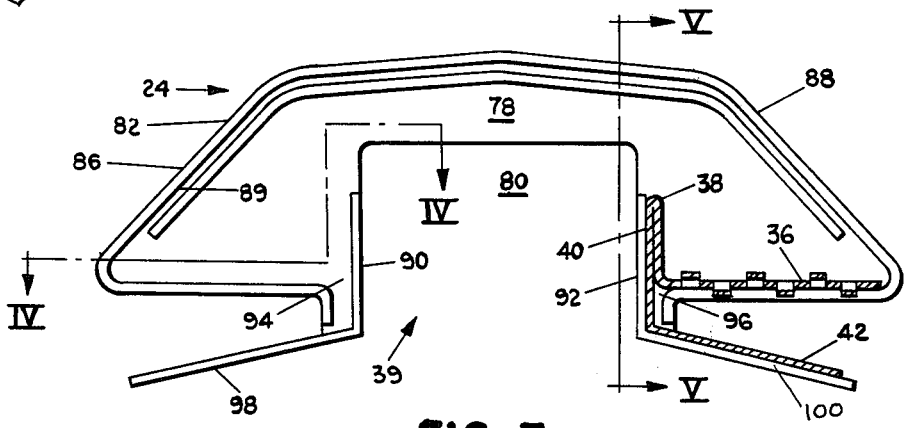
FIG. 3 is a front elevation of a connector element in accordance with the subject invention including a fragmentary portion of a roof ridge ventilator section.

Each vent section 20, as more fully described in copending, commonly owned application, Ser. No. 597,029 filed July 18, 1975, now U.S. Pat. No. 4,000,688 has a hood 26 including depending top portions 28 and 30 and outer sidewalls 32. The outer sidewalls are integral with inwardly extending, horizontally positioned panels 36, as best seen in FIG. 3, and an upwardly extending dam portion 38 (FIG. 3). Downwardly extending inner walls 40 defining the ventilating throat 39 are integral with outwardly extending downwardly angled flashing portion 42.

Figure 6:
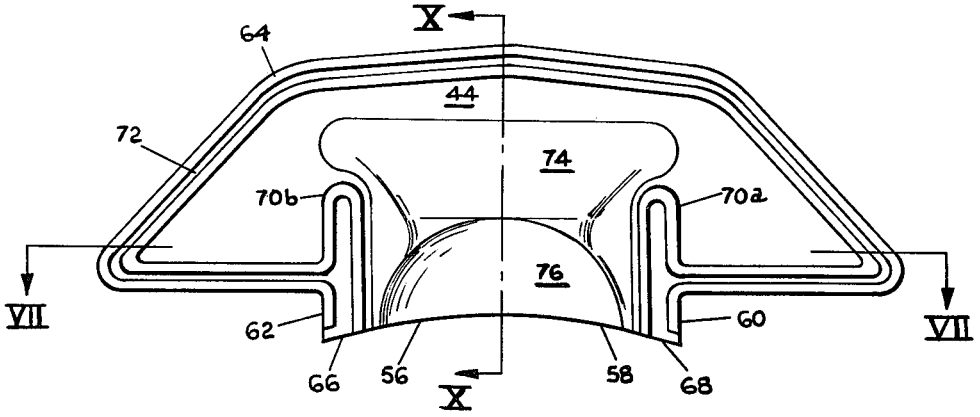
FIG. 6 is a rear elevation of an end cap in accordance with the subject invention.
Figure 8:
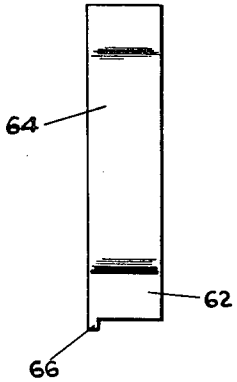
FIG. 8 is a side elevation view of the end cap of FIG. 6.

Referring to FIGS. 2, 6, 7 and 8, the end cap 24 includes a wall having a main portion 44 and a depending leg portion 46. The main wall portion 44 conforms to the general cross-sectional silhouette of the ridge ventilator sections 20 and includes top edges 48 and 50 depending side edges 52 and 54, inwardly extending bottom edges 56 and 58 and depending leg edges 60 and 62. The end cap wall or web therefore conforms to the generally T-shaped cross section of the ventilator. As seen in FIG. 6, an inwardly directed outer jacket or outer peripheral flange 64 extends around the outer peripheral edge of the end cap 24. The outer jacket 64 extends in a longitudinal direction with respect to a ridge vent section 20, peripherally of the cap and terminates just short of the lower edge of leg portions 60 and 62 to define with the leg portions depending tabs 66 and 68 (FIG. 6). An inner flange or sleeve 70 is spaced from the outer jacket 64 and extends parallel to the jacket adjacent the periphery of the main wall portion 44 of the end cap 24.

At the end of the bottom edge portions 56 and 58 the inner sleeve 70 has vertical U-shaped portions **70*a* and 70*b* with the inner leg extending downwardly to the lower edge of the depending leg wall portion 46 (FIG. 6). The outer jacket 64 in conjunction with the inner flange or sleeve 70 define a channel 72 within which the end of the ridge vent sections 20 may be slidably received. The U-shaped portions 70*a* and 70*b* provide pockets for receiving the upstanding dams or baffles 38**

(FIG. 3) of the ventilator. The tabs 66 and 68 of the end caps 24 provide clearance for the flashing portions of the ridge ventilator sections and serve to prevent moisture from entering the interior of the ventilator sections.

Figure 2:
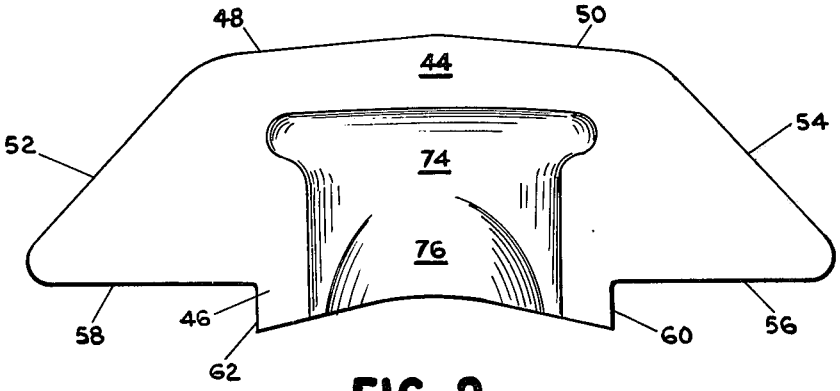
FIG. 2 is a front elevation of an end cap incorporating the subject invention.
Figure 10:
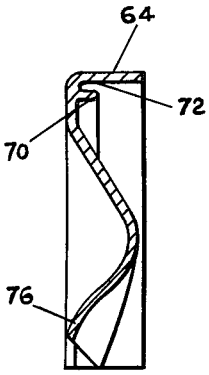
FIGS. 10 and 11 are cross-sectional views taken along line X—X of FIG. 6 depicting the deflection of the wall of the end cap in accordance with the subject invention as the end cap conforms to roofs of different pitches.
Figure 11:
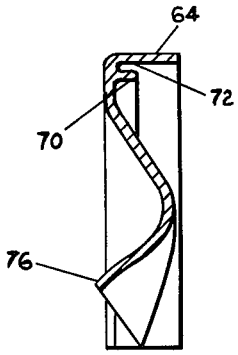
Figure 9:
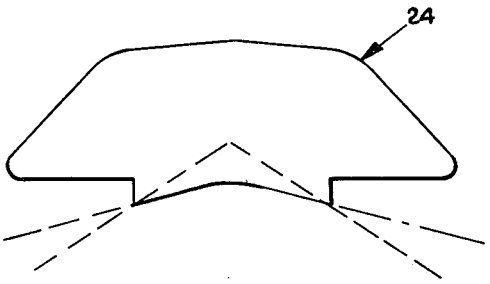
FIG. 9 is a view of the end cap schmetically illustrating a range of roof pitch variation.
Figure 7:
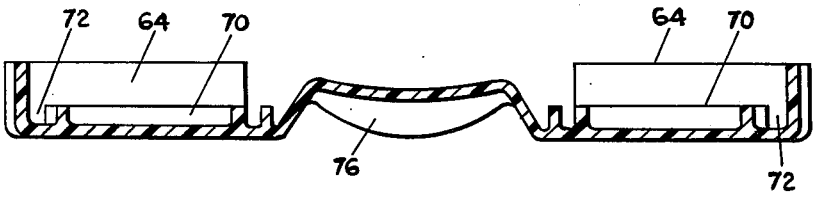
FIG. 7 is a cross-sectional view taken along line VII—VII of FIG. 6.

As best seen in FIGS. 2, 6 and 7, the central area of the main wall portion 44 includes a depression 74, i.e., a generally concave area with respect to the exterior of the cap, which area is somewhat T-shaped and extends generally downwardly and terminates in an outwardly directed bulge 76. The wall 44 as seen in FIG. 2 is inclined inwardly and upwardly to a point generally midway between the top and bottom of the cap to define the bulge and then outwardly and upwardly to define the concave area. The flexible bulge includes a curved portion of the wall or web having a progressively decreasing radius toward the bottom thereof. This structural arrangement results in an end cap having a deflectable wall which readily conforms to different pitched roofs without distoring the remaining body of the end cap. The excess wall length created by the depression or concavity 74 provides an excess of material and a readily manipulated hinge which permits substantial deformation of this center wall without creation of tension and compression stresses in the remaining portions of the end cap which will distort the entire cap (FIGS. 10 and 11). Thus, the cap can be adjusted to accommodate a substantial range of roof pitches without such distortion that it cannot be readily slipped over the end of the ventilator.

Figure 4:
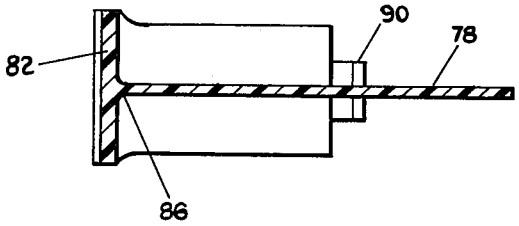
FIG. 4 is a cross-sectional view taken along line IV—IV of FIG. 3.
Figure 5:
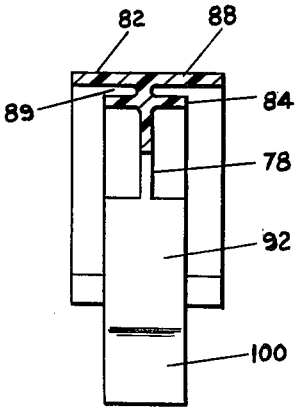
FIG. 5 is a cross-sectional view taken along line V—V of FIG. 3.

As best seen in FIGS. 3, 4 and 5, the connectors 22 in accordance with the present invention, include a intermediate web-like wall 78 having a cutout or opening 80 formed therein. An outer connector or joiner jacket 82 extends around the periphery of the wall 78. The outer jacket is basically a rim or skirt centered about the web 78 whereby it extends equally from each side of the web. An inwardly spaced, inner connector flange or sleeve 84 extends from both sides or faces of the wall 78, in parallel spaced relationship to the outer skirt or jacket 82. The inner sleeve is shorter and terminates intermediate the ends of the outer edge portions 86 and 88 (FIG. 3) of wall 78 to define slots 89. The joiners 22 further include inner jackets 90 and 92 extending vertically along the inner edge of leg portions 94 and 96 of the intermediate wall 78. The inner jackets 90 and 92 (FIG. 3) and lower legs 94 and 96 of the wall 78 are integral with outwardly and downwardly extending flashing tabs 98 and 100.

As best seen in FIGS. 1 and 3, the outer surface of the end of each ventilator section 20 is covered by the outer jacket 82 while the flashing portions 42 of the ventilator are disposed on top of the flashing tabs or legs 98 and 100. The overall arrangement permits the connector sections to engage the ends of adjacent ventilator sections 20 in a waterproof manner.

The end caps 24 and connectors 22 are preferably formed from a resilient, deflectable plastic or rubber material such as ethylene arcylate or ethylene vinyl acetate.

Due to the existence of the cutout portions 80 in the walls or webs 78, each connector is capable of flexing without significant distortion of the slots 89 as the ridge vent sections are fitted to the roof, thereby insuring an adequate waterproof joint between adjacent sections. Further, due to the shape of the deflectable wall of the end caps 24, each end cap is capable of flexing without significant distortion at the channel 72 to thereby effectively maintain a capping seal with the ends of the roof ridge ventilator assembly. This can be best seen in FIGS. 10 and 11. FIG. 11 illustrates the attitude taken by the deflectable wall including the bulge 76 when the end cap is deflected to fit a roof having a greater pitch than that shown in FIG. 10.

In assembling the roof ridge ventilator system, a suitable liquid or semi-liquid sealant and bonding agent or other like compound may be employed in conjunction with the connectors 22 of the subject invention to further insure a moisture proof seal at each joint.

It will be readily appreciated that connectors and end caps in accordance with the present invention may have an outline which differs from that illustrated in the drawings. The important factor, however, is to provide a connector and end cap having the same general outline as each ridge vent section and an inner sleeve and outer jacket to receive and overlap the ends of each ventilator section. It must also be capable of substantial deflection without distortion of its ventilation engaging portions so it will at all times be capable of being easily slipped onto the end of a ventilator section.

The cutout portion of each connector wall results in communication between each roof ridge ventilator section thereby increasing the efficiency of the overall natural attic ventilation arrangement. The deflectable wall including the depression and bulge formed on the end cap permit the overall assembly to adapt to roofs of different pitches. The end caps and connectors permit ready assembly of the roof ridge ventilator at a construction site and alleviate the need for separate cover elements to accommodate each particular roof pitch. Further, the end caps and connectors are easily moldable by high speed automatic equipment permitting use of relatively low cost mass production manufacturing techniques.

Thus, it will be appreciated that the present invention provides an end cap and joiner arrangement which results in a moisture proof connection between roof ridge ventilator sections. The end caps and joiners are easily manufactured and readily adaptable to ventilator assemblies for different roof pitches. It is expressly intended, therefore, that the foregoing description is illustrative of the preferred embodiment only and is not to be considered limiting. The true spirit and scope of the present invention will be determined by reference to the appended claims.

The embodiments of the invention in which an exclusive property or privilege is claimed are defined as follows:

1. An end cap for a generally T-shaped roof ridge ventilator of the type having laterally extending arm portions, said end cap having a generally T-shaped including a leg portion and further having peripheral channel means for slidably seating over the laterally extending arm portions of said T-shaped ventilator, said end cap characterized in that the leg portion of said T-shaped cap and the portion of said T-shaped cap above said leg comprises a wall which from the bottom thereof is inclined inwardly and upwardly to a point generally midway between the top and bottom of said cap and then extends outwardly and upwardly; said wall providing a flexible diaphragm having excess area of wall material therein whereby said cap may be reshaped to adjust it to roofs of a substantial range of pitches without distortion of the remaining portions of said cap.

2. An end cap for a generally T-shaped roof ridge ventilator, said end cap having a generally T-shaped body, said body having a deflectable web forming the exterior generally vertical face thereof and flanges defining a peripheral channel means for slidably seating over the end of a generally T-shaped ventilator, said end cap characterized in that the central portion of said web as viewed from the exterior, has a concavity approximately midway between its top and bottom, the portion of said web below said concavity being bowed outwardly to form a curved portion of progressively decreasing radius toward the bottom thereof to thereby define a flexible bulge.

3. An end cap for sealing the ends of a roof ridge ventilator of the type, having a generally T-shape and flashing portions, said cap comprising:

a deflectable, resilient end cap wall having a main portion and a depending leg portion, said resilient wall shaped so as to conform to the cross section of said ventilator;

an outer end cap jacket longitudinally directed and extending around the periphery of said deflectable end cap wall;

an inner end cap sleeve, longitudinally directed, and extending parallel to said outer end cap jacket adjacent the periphery of said deflectable end cap wall to thereby define in conjunction with said outer end cap jacket a channel adapted to sealingly engage and receive the end of the ventilator assembly; said deflectable wall of said end cap further including a centrally disposed concave depression in said main portion of said deflectable wall and a convex, bulge portion in said depending leg portion of said deflectable wall, whereby said end cap readily conforms with the ventilator to roofs of different pitches.

4. An end cap as defined by claim 3 wherein said outer end cap jacket extends longitudinally further than said inner end cap sleeve.

5. An end cap as defined by claim 4 wherein said outer end cap jacket terminates at each end short of the lower edge of said leg portion of said wall and said inner end cap sleeve terminates at each end at the lower edge of said leg portion to thereby define a pair of tabs, said tabs providing clearance for the flashing portions of said ventilator and preventing moisture from entering the interior of said ventilator.

* * * * *